US009320306B2

(12) United States Patent
Freddi et al.

(10) Patent No.: US 9,320,306 B2
(45) Date of Patent: Apr. 26, 2016

(54) PANTS, IN PARTICULAR FOR SHAPING THE FEMALE BUTTOCKS AND HIPS

(71) Applicant: FREDDY S.p.A., Milan (IT)

(72) Inventors: Carlo Freddi, Chiavari (IT); Margherita Freddi, Leivi (IT)

(73) Assignee: FREDDY S.P.A., Milan (IT)

( * ) Notice: Subject to any disclaimer, the term of this patent is extended or adjusted under 35 U.S.C. 154(b) by 161 days.

(21) Appl. No.: 13/898,097

(22) Filed: May 20, 2013

(65) Prior Publication Data

US 2013/0312157 A1 Nov. 28, 2013

(30) Foreign Application Priority Data

May 24, 2012 (IT) ..... MI2012A0904

(51) Int. Cl.
*A41D 1/06* (2006.01)

(52) U.S. Cl.
CPC ..... *A41D 1/06* (2013.01); *A41D 2300/22* (2013.01)

(58) Field of Classification Search
CPC ..... A41D 1/06; A41D 1/067; A41B 9/12; A41B 2400/38
USPC ..... 2/227, 400, 228, 238, 236, 237; 450/95, 450/98–101, 115–118, 122–124
See application file for complete search history.

(56) References Cited

U.S. PATENT DOCUMENTS 281,790 A 7/1883 Pearson
750,983 A 2/1904 Kendrick
1,863,482 A 6/1932 Isaacs
2,043,538 A 6/1936 Hardie
2,344,374 A * 3/1944 Stephens ..... A41B 9/04 2/401
2,565,866 A * 8/1951 Loftus ..... A41C 1/003 2/407
2,569,229 A 9/1951 Cooper
2,629,094 A 2/1953 Goldsmith
2,668,953 A * 2/1954 Tofanelli ..... A41C 1/04 2/407

(Continued)

FOREIGN PATENT DOCUMENTS

CN 1174685 A 3/1998
CN 1233942 A 11/1999

(Continued)

OTHER PUBLICATIONS

Search Report dated Jan. 30, 2013 from Italian priority application MI2012A 000904.

(Continued)

*Primary Examiner* — Robert J Hicks
*Assistant Examiner* — Jillian K Pierorazio
(74) *Attorney, Agent, or Firm* — Vorys, Sater, Seymour and Pease LLP

(57) ABSTRACT

Pants for shaping the female buttocks and hips including: a first rear part to at least partially cover the buttocks, the first part including: at least one first element to cover at least a lower terminal portion and lateral portion of the buttocks, at least one second element to cover at least a central portion of the buttocks, and at least one third element to cover at least an upper terminal portion of the buttocks. The first, second and third element include a knitted fabric, and the second element includes two parts, each adapted to cover only one of the two central parts of the buttocks. The two parts secured together along respective lateral edges provided at the intergluteal cleft of the buttocks by a central seam adapted to be positioned at the cleft.

19 Claims, 13 Drawing Sheets

(56) References Cited

Figure 1:
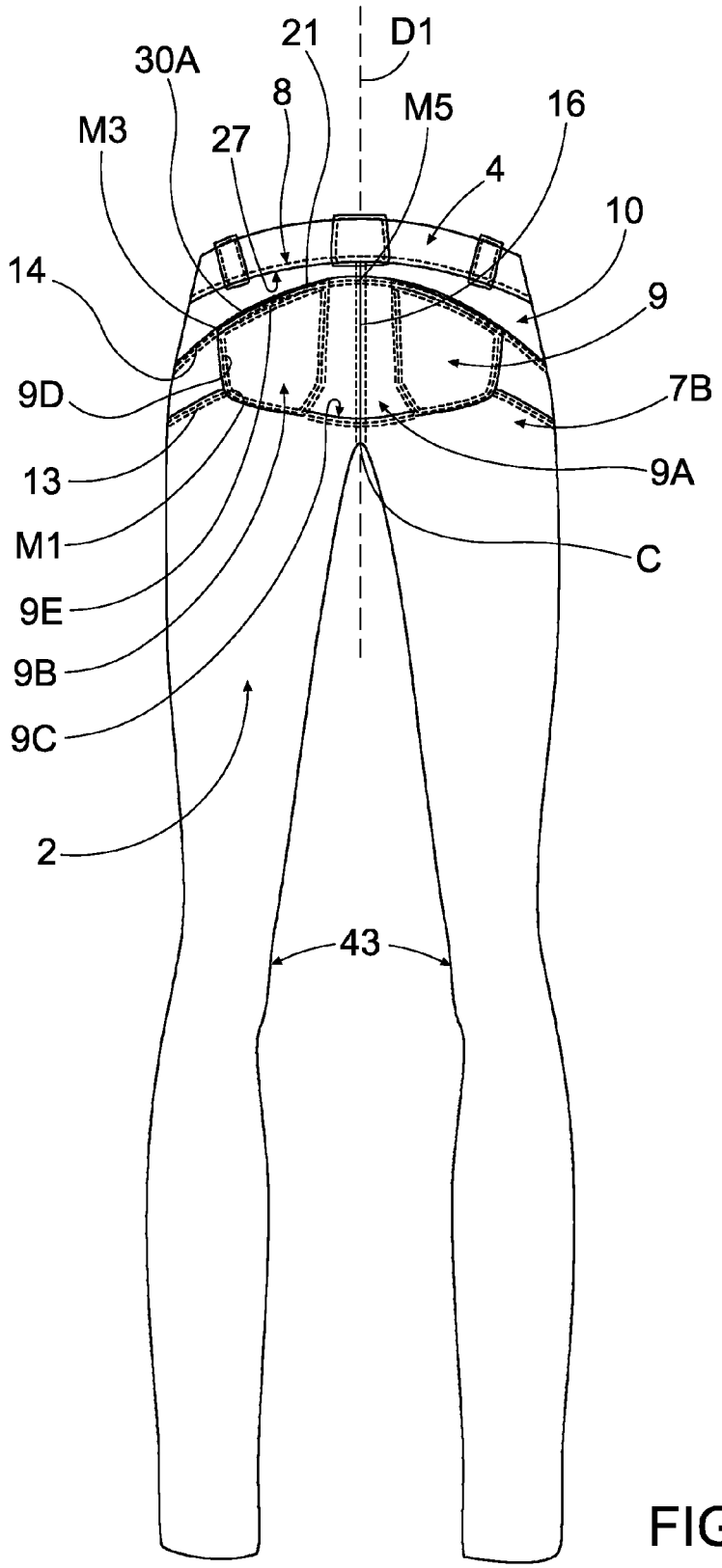

U.S. PATENT DOCUMENTS 2,898,918 A 8/1959 Soteras
2,928,397 A * 3/1960 Pucci ..... A41C 1/003 450/114
3,035,586 A 5/1962 Bell
3,068,871 A * 12/1962 Rapp ..... A41D 1/06 450/95
3,194,241 A * 7/1965 Leoffel ..... A41C 1/003 2/407
3,339,554 A 9/1967 Nobbs
3,406,692 A * 10/1968 Pernas ..... A41C 1/003 450/116
3,438,376 A * 4/1969 Murdock ..... A41C 1/003 450/104
3,459,193 A * 8/1969 Krieger ..... A41C 1/003 450/104
3,526,229 A 9/1970 Blair
3,813,697 A 6/1974 Belpaume
3,835,866 A * 9/1974 Brooks ..... A41C 1/003 450/123
3,877,439 A * 4/1975 Locascio ..... A41C 1/02 450/123
3,894,542 A * 7/1975 Sacristan ..... A41C 1/003 450/123
3,974,836 A * 8/1976 Carlson ..... A41C 1/003 2/408
3,996,622 A * 12/1976 Cooke ..... A41D 1/06 2/227
4,184,494 A 1/1980 King, Jr.
4,261,060 A 4/1981 Zawacki
D262,325 S * 12/1981 Miller ..... D2/742
4,325,379 A * 4/1982 Ozbey ..... A41D 13/0017 450/104
4,392,259 A 7/1983 Bredo
4,625,336 A 12/1986 Derderian
4,850,056 A 7/1989 Gardner et al.
D317,074 S * 5/1991 Beasley ..... D2/742
5,040,244 A 8/1991 Tubbs
5,182,815 A 2/1993 Young
5,375,266 A 12/1994 Crisco
5,649,328 A 7/1997 Martin
5,708,986 A * 1/1998 Belardinelli ..... A41C 1/003 2/400
5,762,535 A * 6/1998 Nishiyama ..... A41B 9/08 2/400
5,784,723 A 7/1998 Noble et al.
5,888,118 A * 3/1999 Kishi ..... A41C 1/003 2/243.1
5,974,592 A * 11/1999 Tabrizi ..... A41B 9/02 2/400
6,041,442 A 3/2000 Owen
RE36,905 E * 10/2000 Noble et al. ..... 2/400
6,182,297 B1 * 2/2001 Duren ..... A41B 9/001 2/228
6,430,752 B1 8/2002 Bay
6,430,753 B2 * 8/2002 Duran ..... 2/239
6,532,599 B1 3/2003 Dugan
6,543,062 B1 * 4/2003 Amsel et al. ..... 2/227
7,074,204 B2 7/2006 Fujii et al.
7,081,036 B1 * 7/2006 Howard ..... A41C 1/00 450/100
7,260,961 B1 * 8/2007 Kennedy ..... D04B 1/243 66/171
7,377,834 B2 * 5/2008 Fu ..... A41C 1/003 450/100
7,500,274 B1 3/2009 Kallen
7,526,929 B2 5/2009 Takamoto et al.
7,533,423 B2 * 5/2009 Rudolph ..... A41D 1/086 2/227
7,546,751 B2 6/2009 Lutz
7,574,752 B1 8/2009 Walters
7,631,367 B2 12/2009 Caillibotte et al.
7,886,367 B2 * 2/2011 Chapuis ..... A41D 13/0015 2/22
7,945,970 B2 * 5/2011 Belluye ..... A41D 13/0015 2/227
8,087,098 B2 * 1/2012 Kimberly ..... A41B 9/001 2/227
8,336,120 B2 * 12/2012 Wong ..... A41B 9/02 2/238
8,381,314 B2 * 2/2013 Takamoto ..... A41D 7/00 2/243.1
8,418,268 B2 4/2013 Waldman et al.
8,533,864 B1 9/2013 Kostrzewski
8,601,615 B2 * 12/2013 Isaacson et al. ..... 2/400
8,784,347 B1 * 7/2014 Smith ..... A61F 5/03 450/99
8,910,317 B2 12/2014 Decker
8,959,665 B1 2/2015 Garner et al.
8,966,667 B2 3/2015 Peck et al.
9,144,252 B1 9/2015 Kostrzewski
2002/0115378 A1 * 8/2002 Nagaoka ..... A41C 1/00 450/115
2003/0233698 A1 * 12/2003 Villalobos ..... A41F 9/025 2/227
2004/0006811 A1 * 1/2004 McKenzie ..... A41B 11/14 2/240
2004/0016043 A1 1/2004 Uno et al.
2004/0111781 A1 * 6/2004 Miyake ..... A41C 1/003 2/69
2005/0091728 A1 * 5/2005 Rocha ..... A41D 1/06 2/227
2006/0230488 A1 10/2006 Rudolph
2006/0253960 A1 * 11/2006 Horn ..... A41D 1/06 2/227
2007/0015439 A1 1/2007 Fu
2007/0082189 A1 * 4/2007 Gillette ..... 428/304.4
2007/0118954 A1 * 5/2007 Lee ..... 2/69
2007/0149093 A1 * 6/2007 Lutz ..... A41B 9/00 450/1
2008/0010725 A1 * 1/2008 Yoo ..... A41B 9/02 2/401
2008/0034476 A1 * 2/2008 MacKinnon ..... A41B 11/003 2/228
2008/0120757 A1 5/2008 Nakazawa
2008/0194181 A1 8/2008 Sudo et al.
2008/0201830 A1 8/2008 Ishida et al.
2008/0216203 A1 * 9/2008 Duncan ..... A41D 1/086 2/22
2008/0271226 A1 * 11/2008 Erana Ahumada ..... 2/228
2009/0007311 A1 1/2009 Semba et al.
2009/0025115 A1 1/2009 Duffy et al.
2009/0031470 A1 * 2/2009 Ishikawa ..... A41D 1/06 2/69
2009/0113596 A1 5/2009 Young
2009/0113598 A1 * 5/2009 Maier ..... A41D 1/084 2/79
2009/0300826 A1 * 12/2009 Harimoto ..... A41B 9/02 2/403
2010/0107299 A1 5/2010 Ota et al.
2010/0162466 A1 7/2010 Fukuyo et al.
2010/0162470 A1 7/2010 Kim
2010/0192283 A1 * 8/2010 Kim ..... A41D 1/06 2/227
2011/0099677 A1 * 5/2011 Mamiye ..... A41D 27/02 2/67
2011/0173741 A1 * 7/2011 Georgis, Jr. ..... A41B 9/02 2/400
2011/0179552 A1 7/2011 Bickley et al.
2011/0209267 A1 * 9/2011 Rush ..... A41D 1/08 2/228
2011/0214216 A1 * 9/2011 Zarabi ..... 2/69
2011/0289648 A1 12/2011 Burke
2012/0060253 A1 * 3/2012 Bergin ..... A41C 1/003 2/69
2012/0096627 A1 * 4/2012 Gosse ..... A41D 1/082 2/227
2012/0204313 A1 * 8/2012 Evans ..... A41F 5/00 2/70
2012/0210487 A1 8/2012 Albin et al.
2013/0036530 A1 2/2013 Bartlett
2013/0239294 A1 9/2013 Clement et al.
2013/0305425 A1 * 11/2013 Zarabi ..... 2/69
2014/0026293 A1 * 1/2014 Quistian, Jr. ..... A41D 1/06 2/227

(56) References Cited

U.S. PATENT DOCUMENTS

| | | | | |
|---|---|---|---|---|
| 2014/0096301 | A1 | 4/2014 | Waller et al. | |
| 2014/0150166 | A1 | 6/2014 | Hall et al. | |
| 2014/0165264 | A1 | 6/2014 | Safran et al. | |
| 2014/0165265 | A1* | 6/2014 | Tulin | A41D 1/06 2/234 |
| 2015/0107000 | A1 | 4/2015 | Tanaka et al. | |
| 2015/0201679 | A1 | 7/2015 | Wong | |
| 2015/0208744 | A1 | 7/2015 | Smith | |
| 2015/0313302 | A1 | 11/2015 | Boyle | |

FOREIGN PATENT DOCUMENTS

| | | | |
|---|---|---|---|
| CN | 2676656 | Y | 2/2005 |
| CN | 101163419 | A | 4/2008 |
| DE | 20102650 | U1 | 9/2001 |
| EP | 1502513 | A1 | 2/2005 |
| EP | 1872675 | A1 | 1/2008 |
| EP | 2666377 | A1 | 11/2013 |
| JP | 2005256219 | A | 9/2005 |
| JP | 03155508 | U | 10/2009 |
| JP | 2012021236 | A | 2/2012 |
| KR | 100973673 | B1 | 8/2010 |
| WO | 2009053935 | A1 | 4/2009 |
| WO | 2010136972 | A1 | 12/2010 |

OTHER PUBLICATIONS

Search Report dated Jan. 30, 2013 from Italian priority application MI2012A 000907.

Unpublished U.S. Appl. No. 13/898,184 to Freddi et al, filed May 20, 2013.

Andrea Mariett, Expert's Report, Milan Court, Section specializing in business—Sec. A, civil case R. G. 29939/2013, pp. 1, 22-28, 68, Nov. 15, 2013.

Non-Final Office Action issued Mar. 10, 2016 for U.S. Appl. No. 13/898,184 to Freddi filed Mary 20, 2013.

* cited by examiner

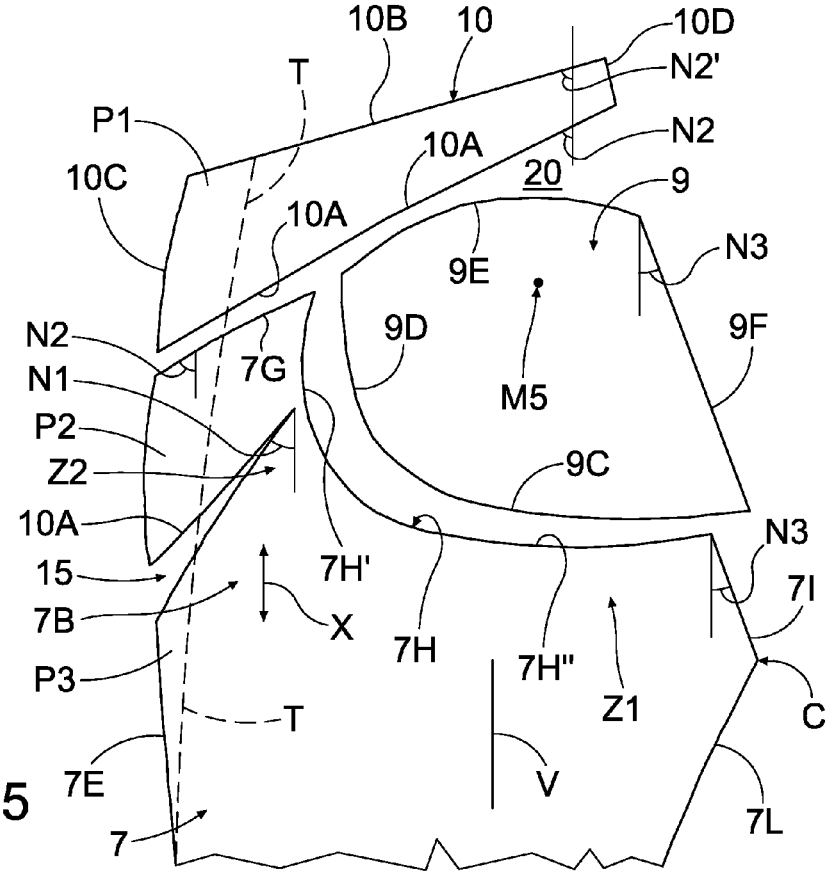
FIG.5
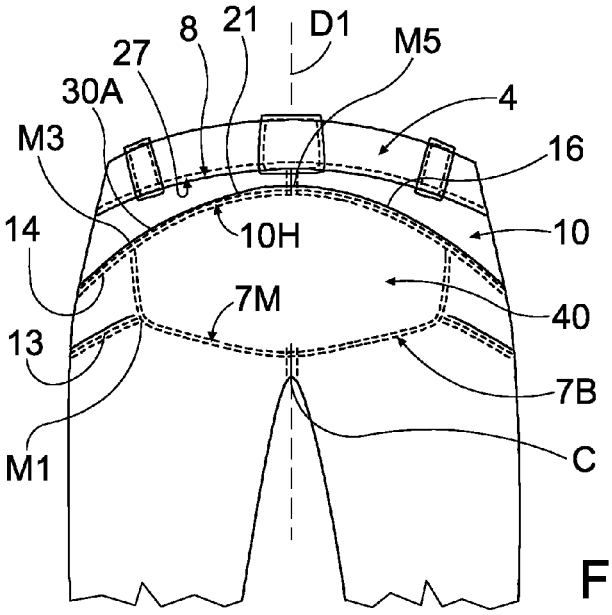
FIG.1BIS

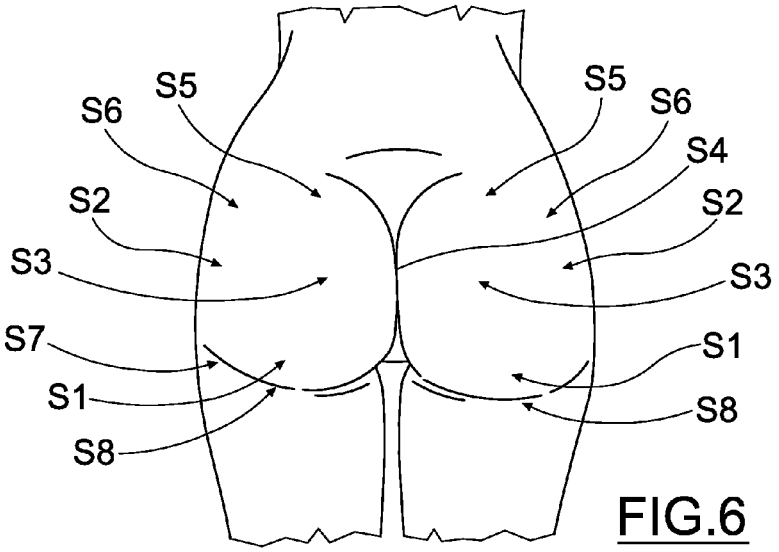
FIG.6
FIG.7A
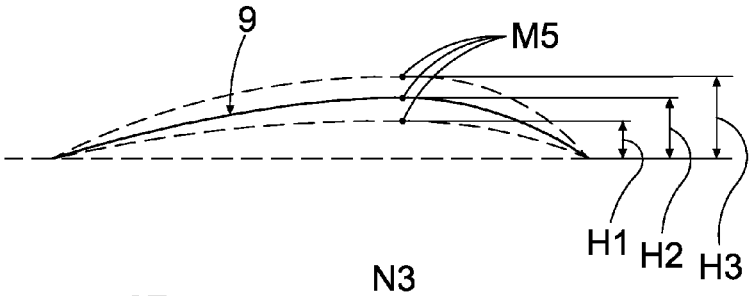
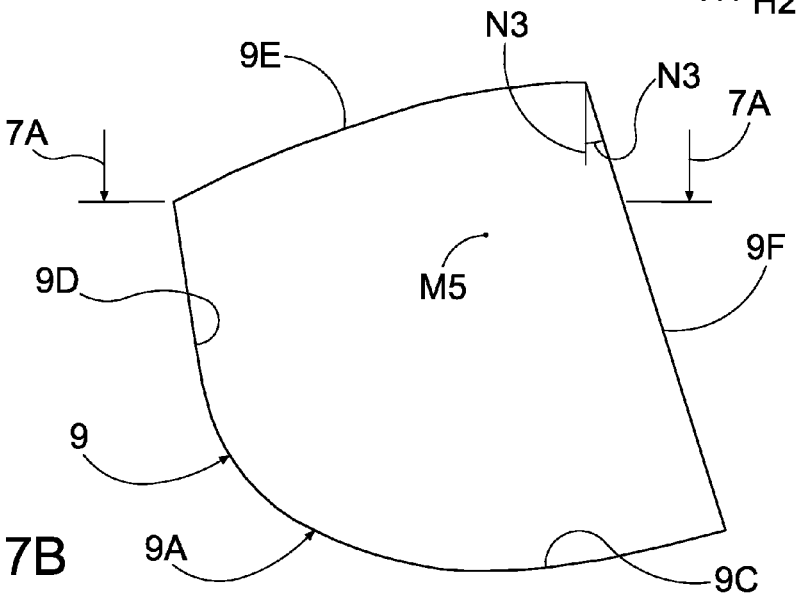
FIG.7B

PANTS, IN PARTICULAR FOR SHAPING THE FEMALE BUTTOCKS AND HIPS

CROSS-REFERENCE TO RELATED APPLICATIONS

This claims the priority of Italian Patent Application No. MI2012A000904 filed on May 24, 2012, incorporated herein by reference.

FIELD OF THE INVENTION

The present invention relates to pants for shaping the female buttocks and hips.

In the present context the term "pants" means a garment to be used as an article of clothing which remains in view when worn, i.e. not an article of underclothing, and which can have or not have parts adapted to cover the legs. The term "pants" in the present context also includes shorts (i.e. pants without parts for covering the legs), short pants and pants with legs of any form and length.

BACKGROUND OF THE INVENTION

Pants for shaping the buttocks and hips of the wearer have been known for some time, these known pants generally comprising a body-shaping garment or corset provided inside the pants and adapted to shape the buttocks or hips, and secured to the actual pants, see for example U.S. 2007118954 A1 or U.S. Pat. No. 5,888,118 or EP 1872675. Although these known pants are adapted to shape the wearers hips and buttocks, they do not cause the fabric of the pants to also adhere to the buttocks and hips such as to display them and highlight the shape of those parts of the body.

Known body-shaping pants or garments, for example those described in U.S. Pat. No. 4,392,259, U.S. Pat. No. 3,996,622, U.S. 20061253960, U.S. Pat. No. 3,068,871, have always been produced up to the present time in fabrics presenting good retentive characteristics, for example shuttle-woven fabrics.

Up to the present time the expert of the art has not produced buttocks and hip shaping pants in a knitted fabric because this type of fabric is considered to be unsuitable for retaining and shaping the female body, it being considered a "yielding" fabric, i.e. with constructional characteristics not suitable or sufficient to sustain or shape anatomical parts and therefore not suitable for use in an article of clothing which has to bind, retain and shape the buttocks and hips.

SUMMARY OF THE INVENTION

An object of the present invention is to provide pants which while having at least that part adapted to cover the buttocks and hips made of knitted fabric, is nevertheless able to shape the buttocks and hips of the wearer, while at the same time causing the fabric of the pants to adhere to the buttocks and hips such as to highlight the shapes of said parts of the body.

A further object is to provide pants able to highlight each of the two parts of the buttocks separated by the intergluteal cleft.

A further object is to provide pants which comprise a limited number of components, are easy and quick to produce and can be manufactured industrially with fabrics of conventional type.

A further object is to provide a set of pants which for the appropriate size are adaptable to the different forms of the buttocks of the wearer of the pants.

These and other objects which will be apparent to an expert of the art are attained by pants in accordance with the accompanying claims.

BRIEF OF THE DRAWINGS

Figure 2:
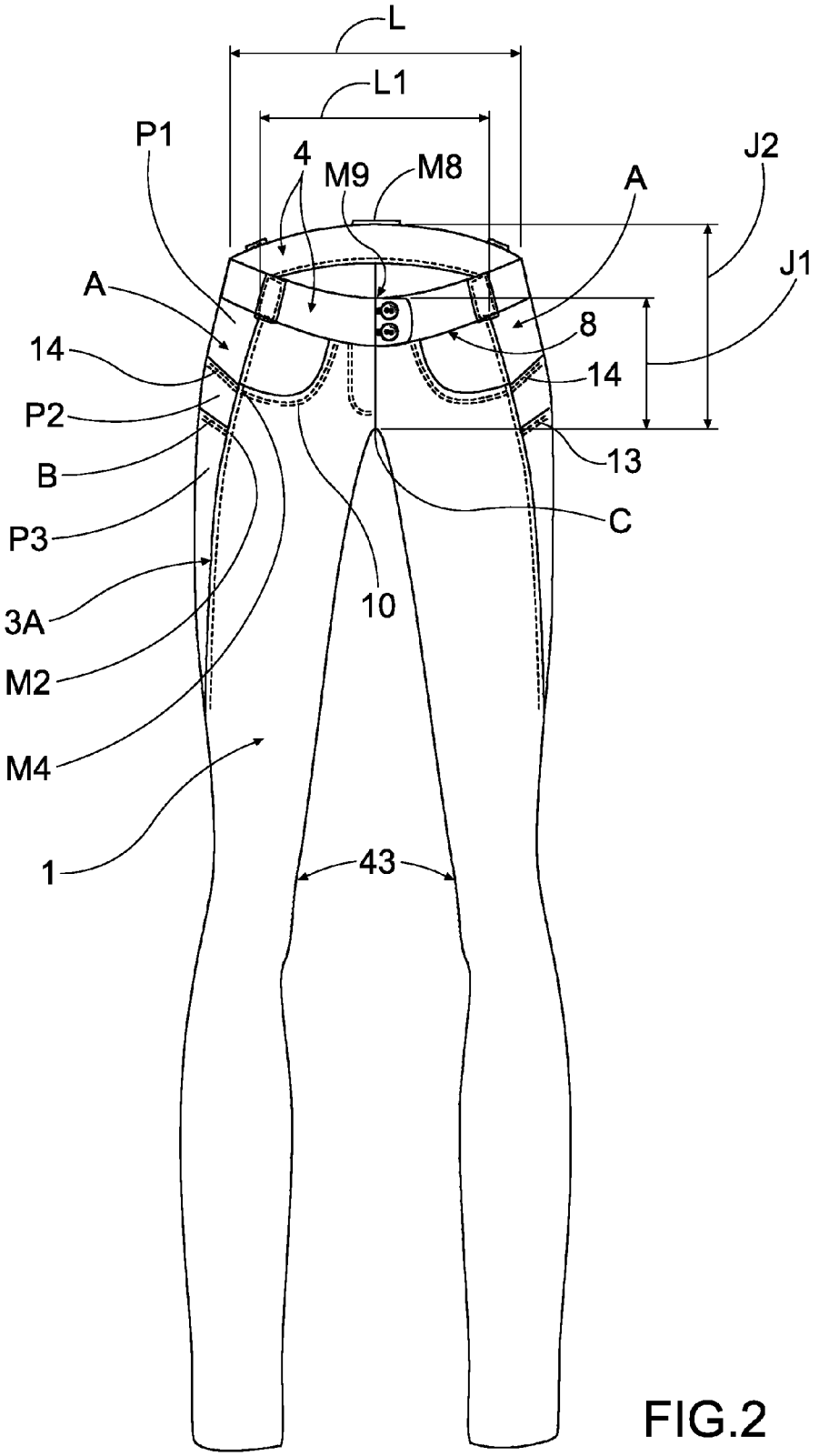
Figure 3:
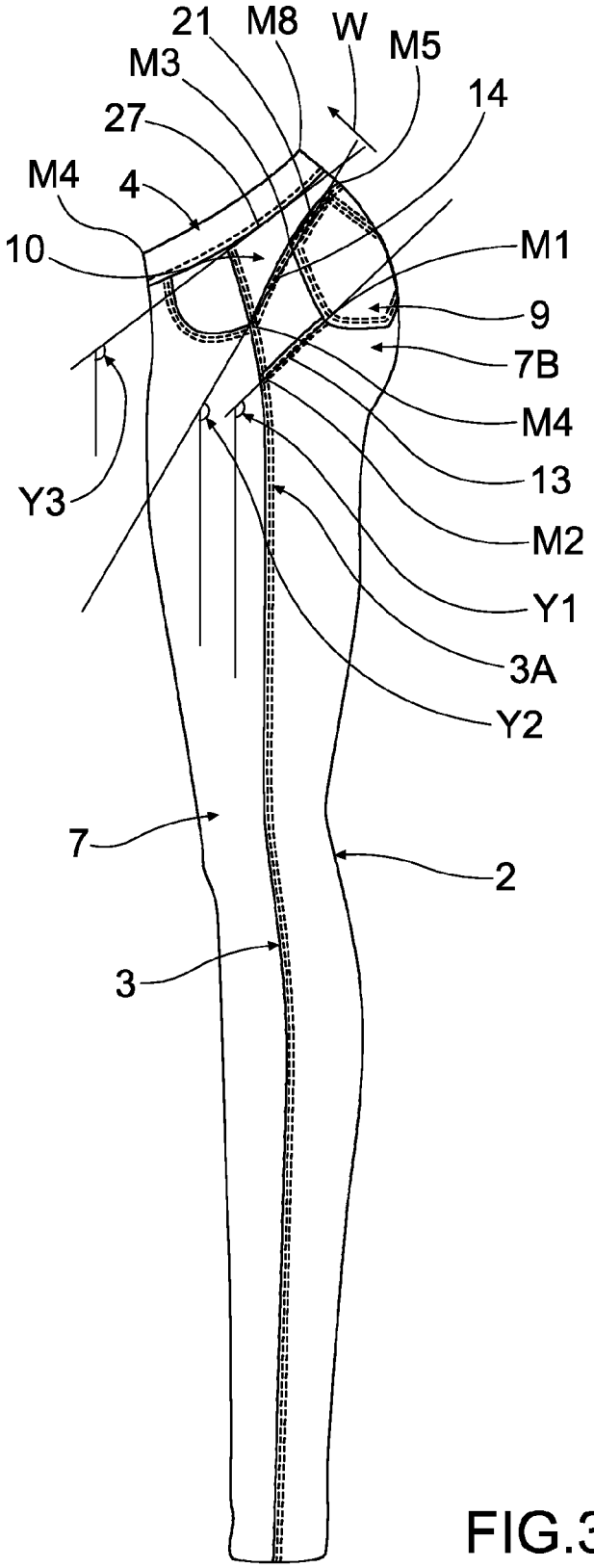
Figure 4B:
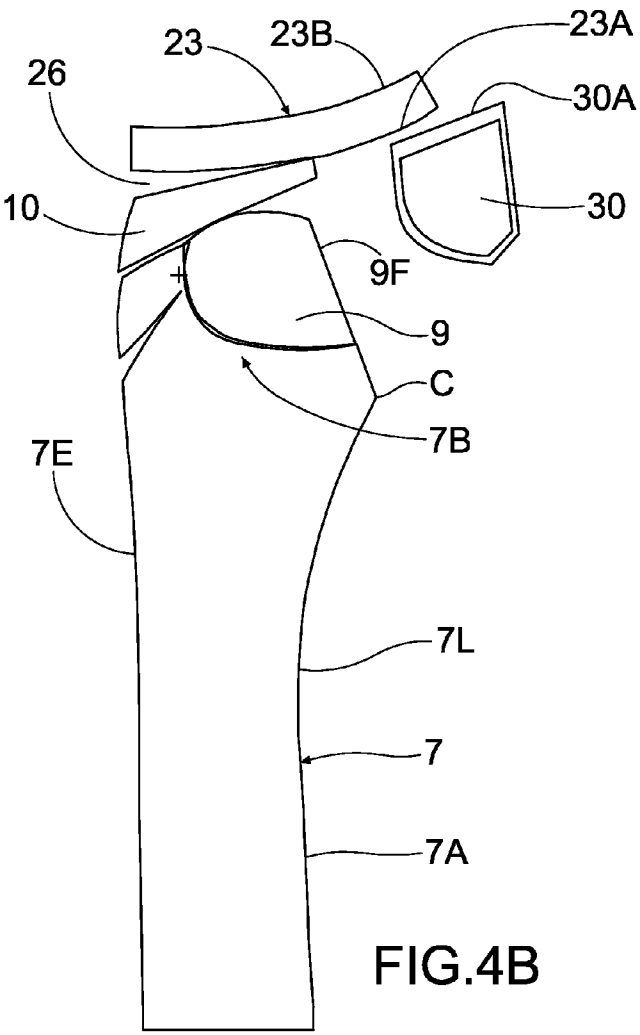
Figure 4A:
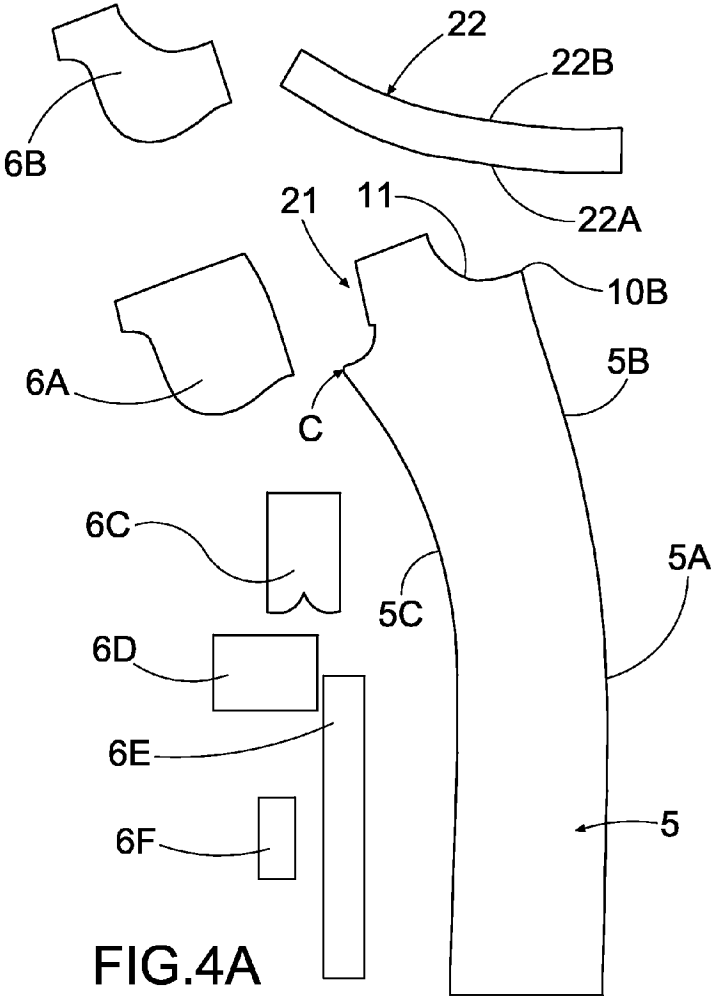
Figure 8:
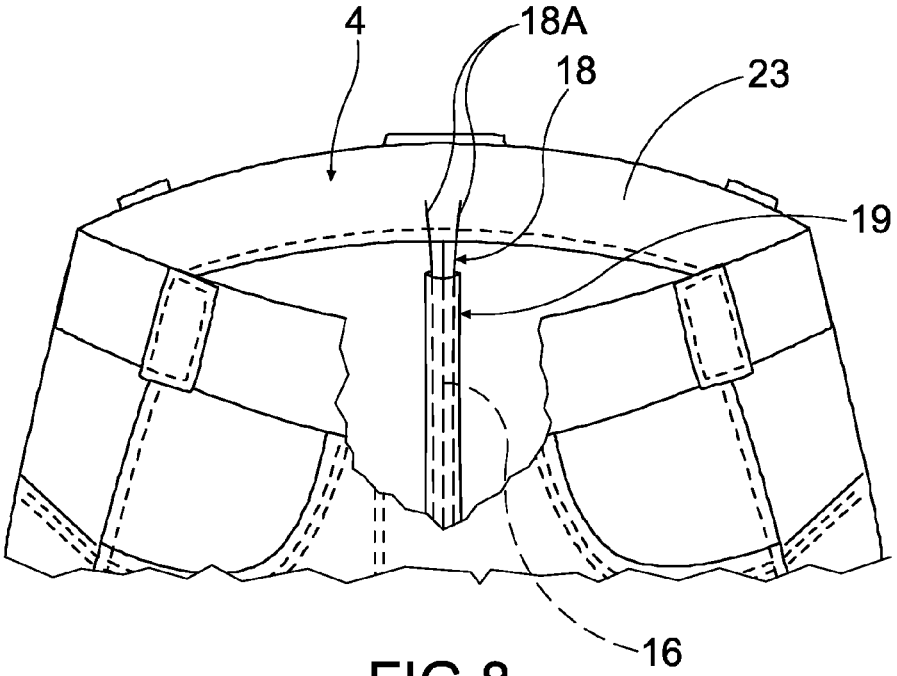
Figure 9:
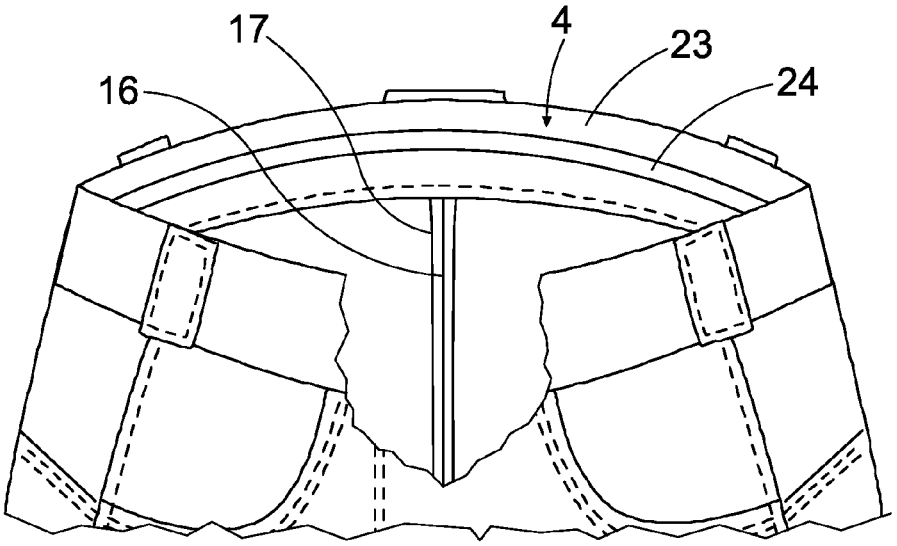
Figures 10A, 10B:
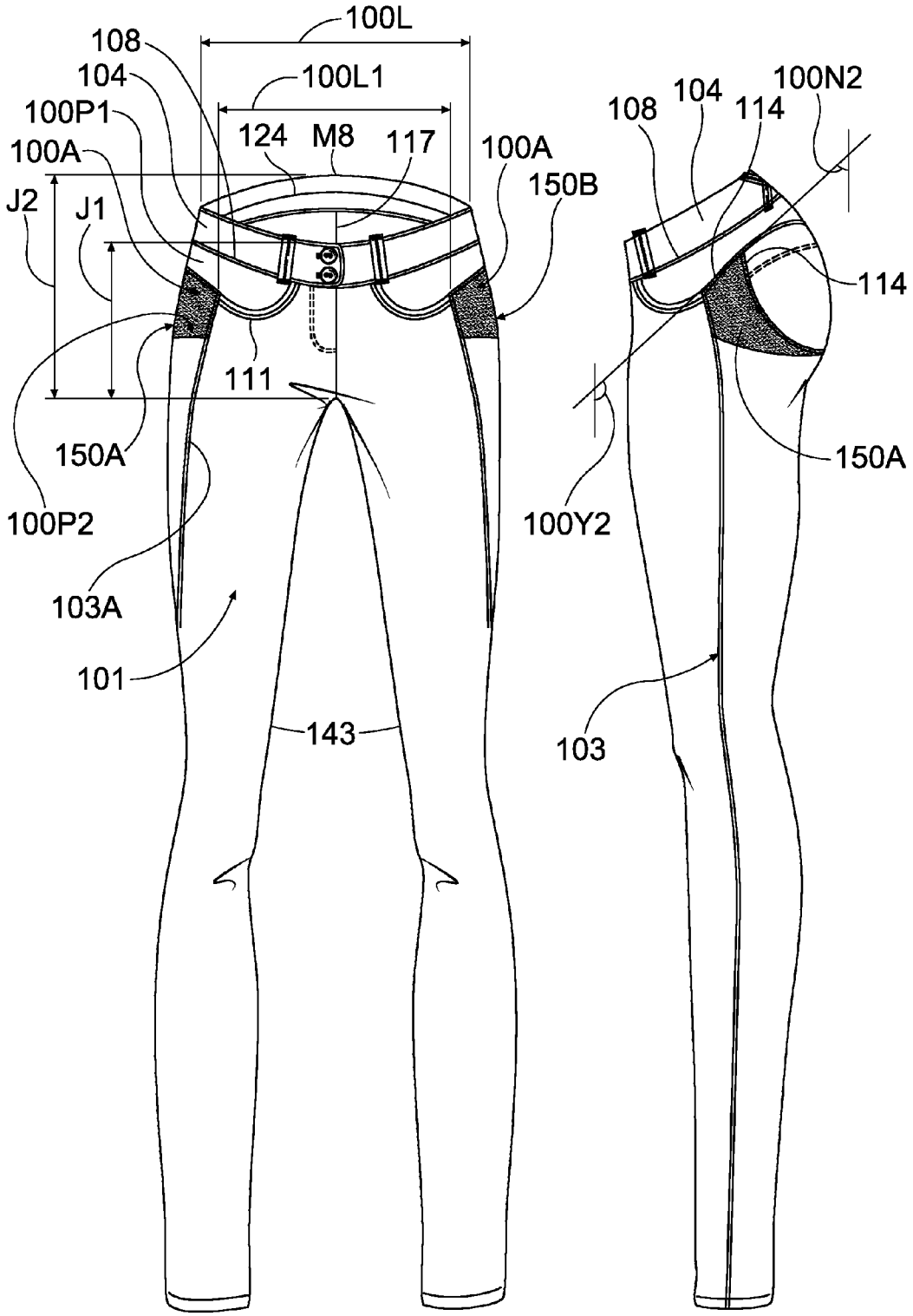
Figure 10C:
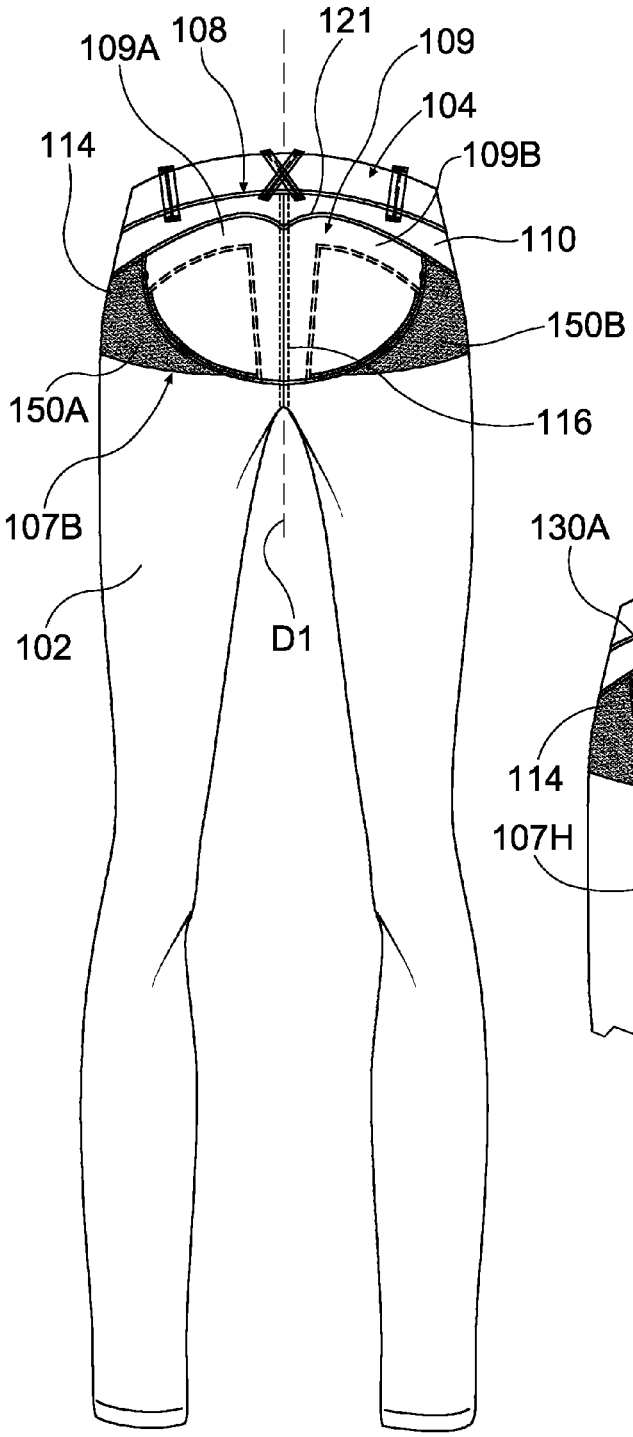
Figure 10D:
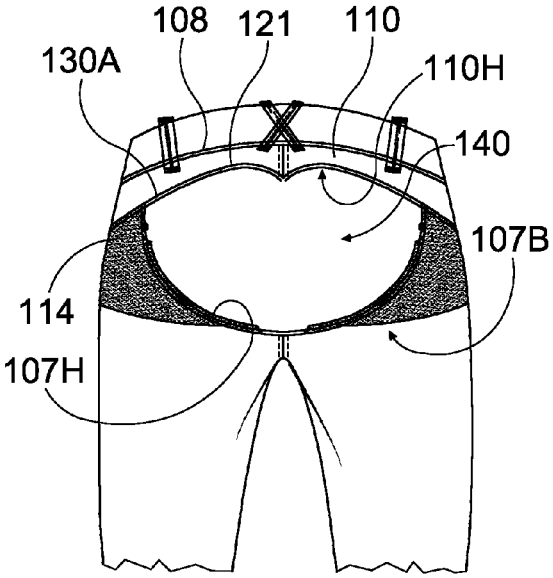
Figures 11A, 11B:
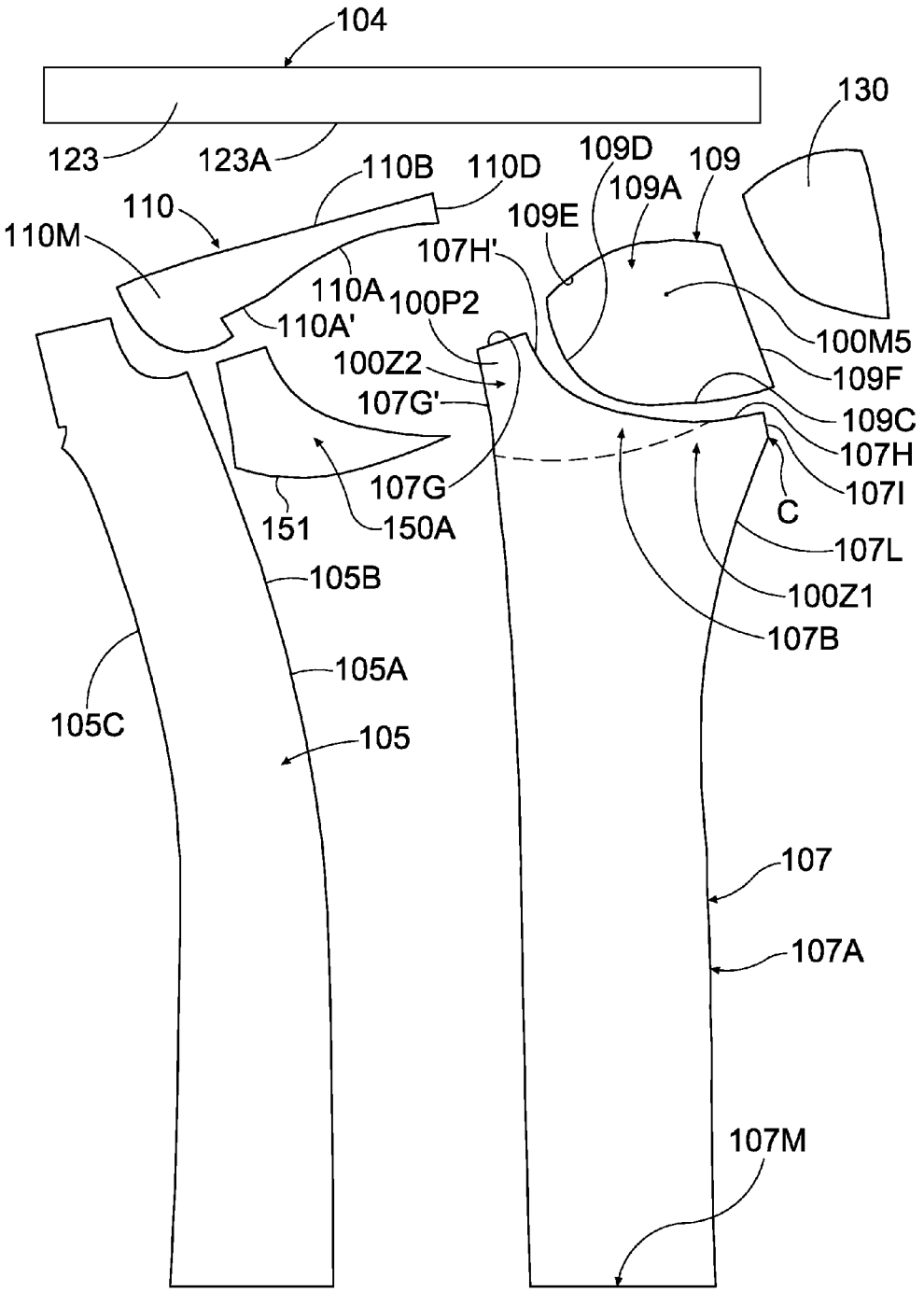
Figures 12A, 12B:
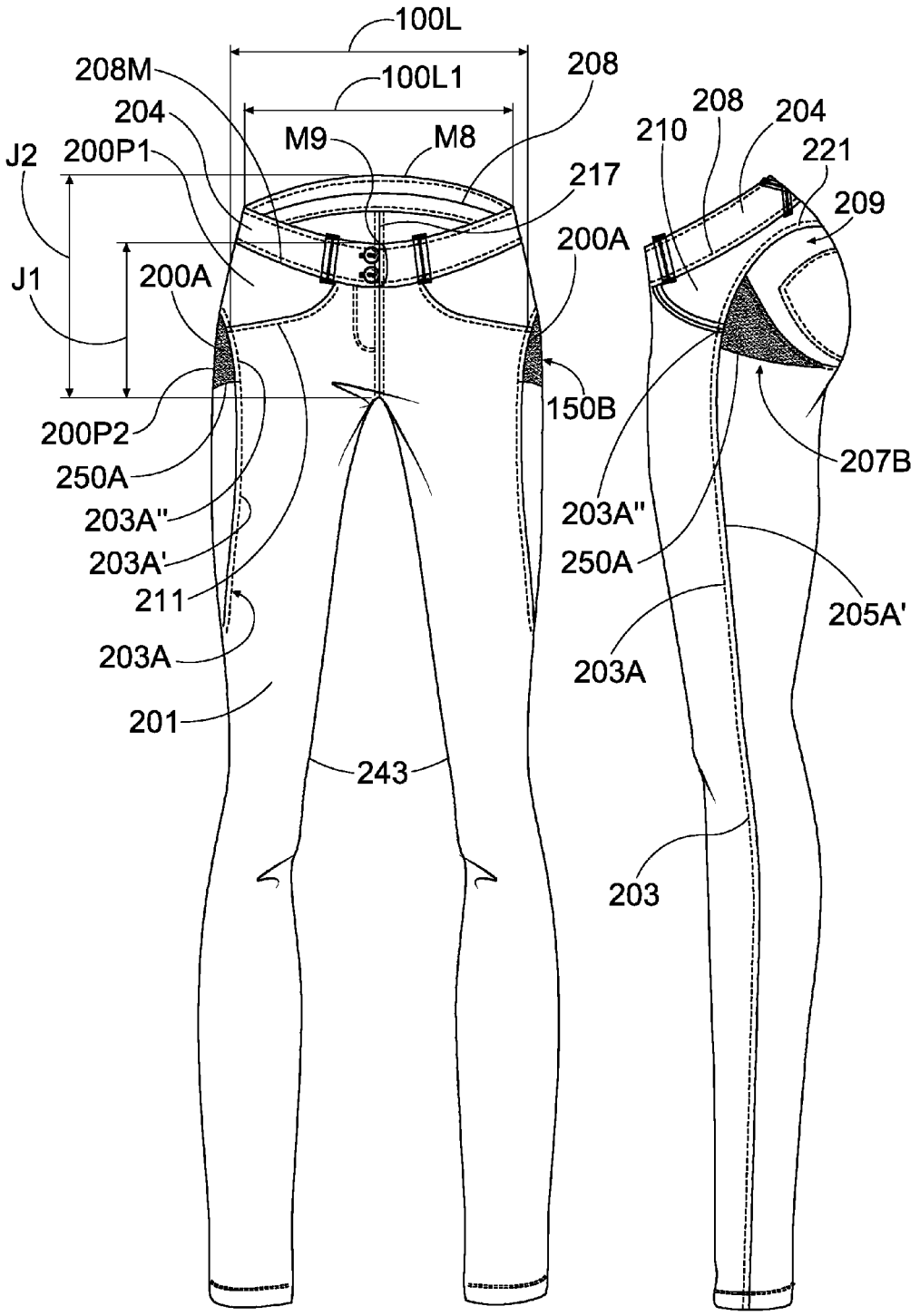
Figure 12C:
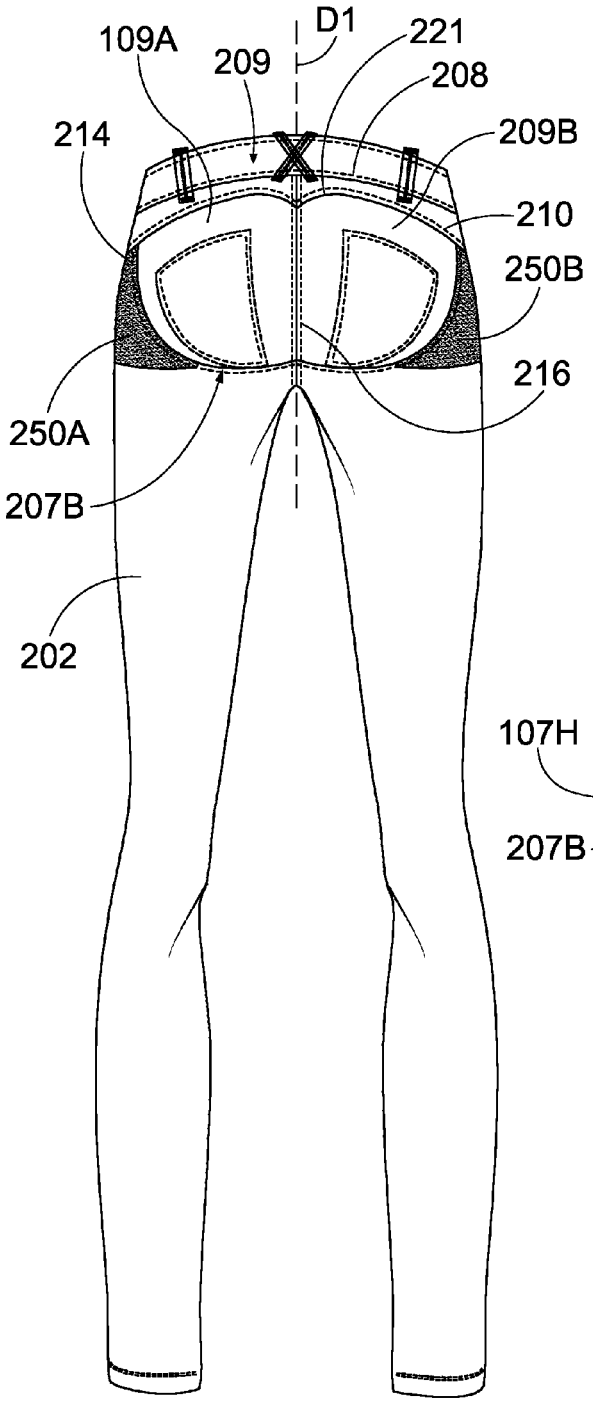
Figure 12D:
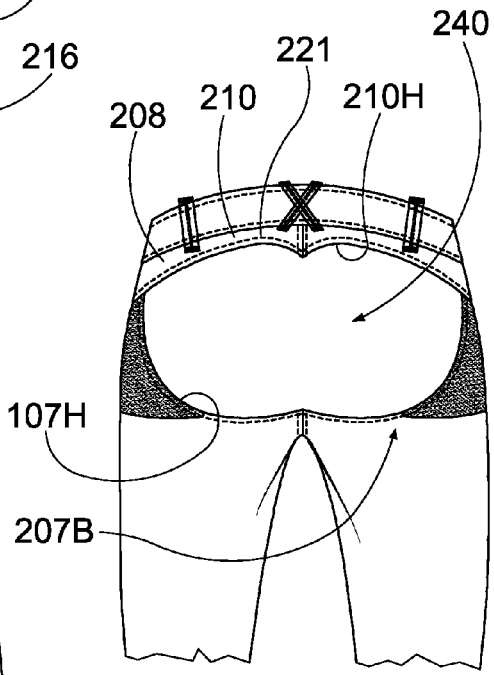
Figures 13A, 13B:
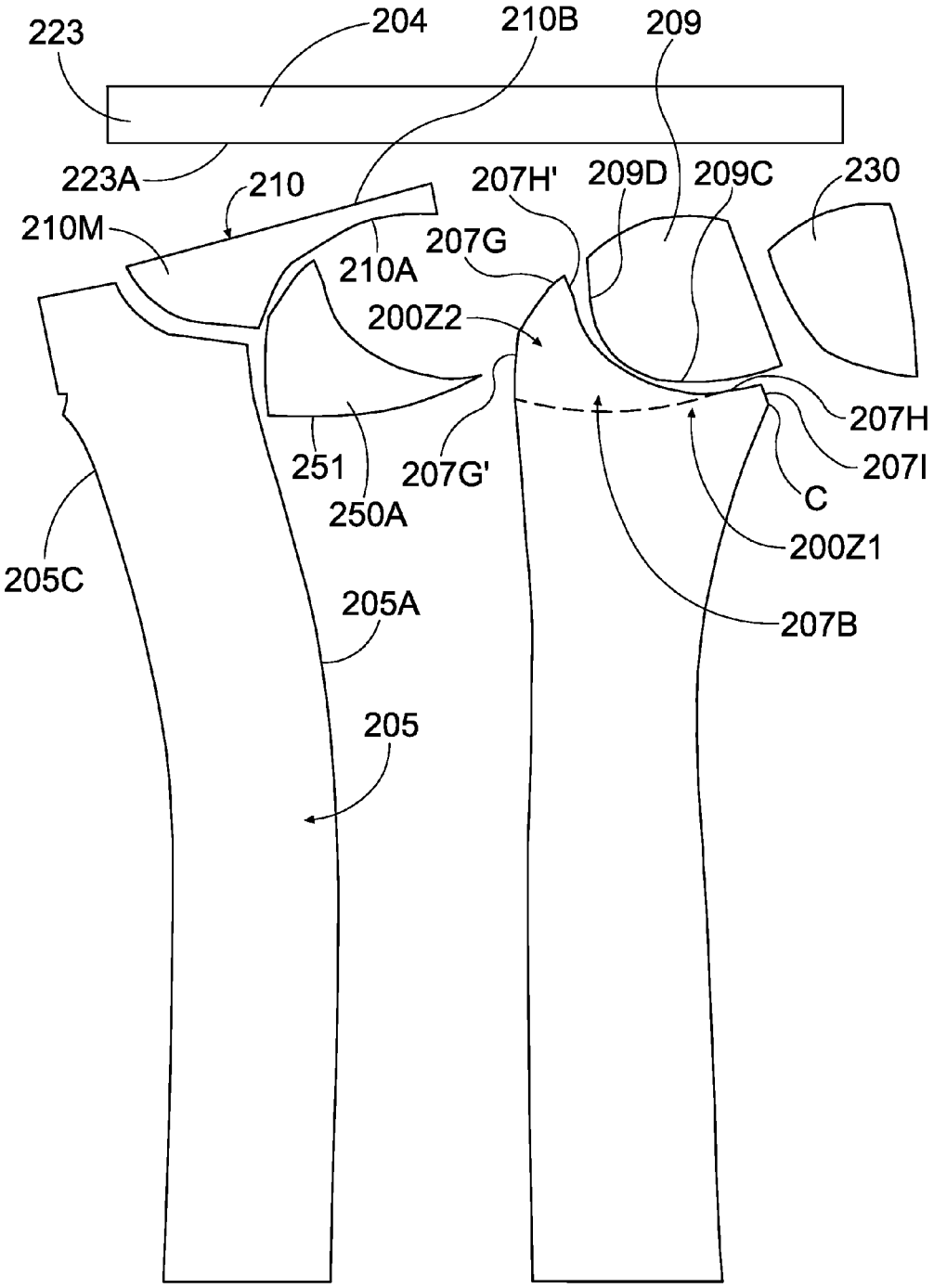

The present invention will be better understood from the accompanying drawings, which are provided by way of non-limiting example and in which:

FIGS. 1, 2, 3 are respectively a rear, front and lateral schematic view of pants according to the invention, FIG. 1BIS shows pants in the same view as FIG. 1 but with that part of the pants adapted to cover a central portion of the buttocks removed to better show the shape of the rear part of the pants, FIGS. 4A, 4B show a plan view of the main elements for producing the pants of FIGS. 1-3, before being sewn together, FIG. 5 shows an enlargement of a detail of FIG. 4B, FIG. 6 shows a perspective schematic design of female buttocks, FIGS. 7A and 7B show schematic plan and sectional views of a detail of the pants according to the invention, FIGS. 8 and 9 show enlarged views of a detail of the pants indicated in FIG. 2 by the arrow L, in two different embodiments, FIGS. 10A, 10B, 10C, 10D are front, lateral and rear views of a further embodiment of pants according to the invention, FIGS. 11A, 11B show a plan view of the main elements for producing the pants of FIGS. 10A, 10B, 10C, 10D, before being sewn together, FIGS. 12A, 12B, 12C, 12D are front, lateral and rear views of another further embodiment of pants according to the invention, FIGS. 13A and 13B show a plan view of the main elements for producing the pants of FIGS. 12A, 12B, 12C, 12D, before being sewn together.

DETAILED DESCRIPTION OF THE PREFERRED EMBODIMENTS

FIGS. 10A, 10B, 10C show a first embodiment of pants according to the invention for shaping female buttocks and hips, which in the particular embodiment illustrated are women's sports pants of the type adapted to completely cover the legs. It should be noted that according to the invention, the pants can have legs of any length, width and shape, and can also be substantially without legs (for example to produce pants of "shorts" type).

The pants according to the invention are of the type comprising: a first rear part 102 adapted to at least partially cover the buttocks, and a second front part 101 adapted to at least partially cover the abdomen and having an inseam 143. The first part 102 comprises: at least one first element 107B adapted to cover at least one lower terminal portion S1 (FIG. 6) and lateral portion S2 of the buttocks, at least one second element 109 adapted to cover at least one central portion S3 of the buttocks, and at least one third element 104, 110 attached by a seam 108 (FIG. 10C) having an arched portion 110H (FIG. 10D), adapted to cover at least one upper terminal portion S5 of the buttocks.

According to the invention:

a) the first element 107B, second element 109 and third element 110, 104, comprise a knitted fabric, b) the first element 107B and third element 110 define a central aperture 140 (visible in FIG. 10D), c) the outer edges 109C, 109D, 109E of said second element 109 are secured to the edges 107H, 110A defining said aperture of said first element 107B and third element 110, 104, so as to close said aperture, d) said second element 109 comprises two parts 109A, 109B each adapted to cover only one of the two central parts S3 of the buttocks, e) said two parts are joined together along lateral edges 109F provided at the intergluteal cleft S4 of the buttocks, by a central seam 116 to be positioned at said cleft S4.

Preferably the rear part 102 of the pants also comprises a lower portion 107A adapted to cover the rear of the legs.

Preferably the first element 107B and the third element 110 of the first rear part 102 of the pants have a two-dimensional form and are therefore flat elements when not associated with the other pants elements, whereas the two second parts 109A, 109B of the element 109 can have either a flat form or a cup-shaped three-dimensional form (as explained hereinafter). According to the invention, the first element 107B, provided at the buttocks, presents two parts each comprising regions (visible in FIG. 11B):

a first lower region 100Z1, extending substantially horizontal, adapted to position itself at and cover a terminal central lower portion S1 (FIG. 6) of the buttocks at the lower edge of the buttocks, and bounded upperly by a first arched edge 107H having a first radius of curvature and laterally, at the fork C of the pants, by an inclined rectilinear edge 107I to be inserted into the intergluteal cleft (as explained hereinafter), and a second region 100Z2 connected to the first and extending substantially vertical, adapted to position itself at, and cover, a central lower lateral portion S2 of the buttocks in the lower part of the pants and a lower front band of the hips in the front part of the pants, said region 100Z2 being bounded laterally, in its part closest to the intergluteal cleft S4, by a second arched edge 107H', connected to the first and having a second radius of curvature slightly less than the first.

The regions 100Z1 and 100Z2 are adapted to position themselves at the central and lower lateral part of the buttocks, next to the two most projecting and convex central portions S3 (FIG. 6) of the buttocks.

A prolongation 100P2 is provided in the region 100Z2 (FIG. 11B) of the element 107, to extend into the front part of the pants.

The first element 107B terminates upperly with an inclined edge to be sewn to a corresponding portion of the inclined edge 110A' of the third element 110 portion 110M, these two edges having substantially the same inclination and being sewn together to form an inclined or arched seam or dart 114 (FIG. 11B), which extends from the rear part 2 of the pants to the front part 1, and connects to the front pockets and, in the rear part of the pants, to the seam of the central part 109. Also FIG. 10C shows edges of the first element and third element entirely define a central aperture. Also, FIG. 10C shows the first element 107B comprises two first element parts, each comprising a first region 100Z1 (FIG. 11B) adapted to cover only one of the two most lower central parts of the buttocks, the two first element parts 107B secured together along respective lateral edges 107I (FIG. 11B) for being provided at the intergluteal cleft of the buttocks by a first element central seam adapted to be positioned at the intergluteal cleft, the first element central seam extending continuously from a crotch C (FIG. 11B) of the pants to the second element central seam 116 formed by parts 109A and 109B of the second element 109. Also, the third element 110 comprises two third element parts, each comprising a third element region adapted to cover only one of the two upper central terminal portion of the buttocks, the two third element parts secured together along respective lateral edges 110D (FIG. 11B) for being provided at the intergluteal cleft of the buttocks by a third element central seam adapted to be positioned at the intergluteal cleft, the third element central seam extending continuously from the second element central seam. As FIG. 10C shows parts of the first element 107B, second element 109, and the third element 110 are attached to provide a continuous intergluteal cleft seam from the crotch to the upper end of the buttocks.

Preferably, as visible in FIG. 10B, the dart 114 in lateral view has an inclination to a vertical axis such as to form an angle 100Y2 of between 110° and 165° and preferably equal to about 140°. Preferably the minimum point of the dart 114 coincides with the lower starting point of the front edge of the front pockets 111 of the pants.

The first element 107B has its arched edge 107H (FIG. 11B) substantially of compressed-C shape, adapted to be sewn to a corresponding arched edge 109C of the parts 109A, 109B of the element 109, adapted to cover and support the most projecting and convex central portion S3 of the buttocks.

The rectilinear edge 107I, provided at the fork C, is advantageously inclined to the vertical V of the element 107 by an angle N3 between 10° and 50° (the angle N3 is represented only with reference to the embodiment shown in FIG. 5).

Finally the first element 107B presents a conventional edge 107L which extends from the fork C to a usual lower end edge 107M of the element 107, and is adapted to be sewn to a corresponding edge 105C (FIG. 11A) of the elongate element 105 of the front part of the pants.

According to this first embodiment, the first element 107B comprises two inserts 150A, 150B (which in FIGS. 10A-10D are shown grey, although in reality they are not visible from the outside, being inside the pants), to make the two bands of said part 107B comprising said inserts less elastic and more tenacious, and hence more retentive. These inserts preferably have a shape and dimensions such as to overlie the upper second region 100Z2 of the first element 107B as far as the edges 107H', 107G and 107G' of said second region 100Z2, such that when the pants are worn, the greater thickness due to the presence of the insert will be noted only at the lower arched edge 151 of the insert, which however preferably extends along the lower portion of the buttocks, i.e. of that portion most curved towards the interior and is therefore less visible, such that when the pants are worn, this thickness difference is virtually not visible. The two inserts are dimensioned and shaped such as to cover: a portion of the hips, a lateral portion S2 of the buttocks and a lower lateral portion S7, preferably at the horizontal cleft S8 of the buttocks without however reaching the intergluteal cleft S4. These inserts are preferably made of a plastic material, preferably of polyurethane and more preferably of silicone, which is made to adhere to the inner face of the pants fabric. These inserts preferably present the following characteristics: weight between 30 and 130 g/m$^2$; thickness between 0.02 and 0.5 mm; surface continuous or presenting a plurality of holes (to facilitate breathability). These inserts are preferably made to hot-adhere under pressure by techniques conventional to the expert of the art. For example the inserts are made of a material marketed by the Italian company A. R. T. Line s.r.l. According to this embodiment of the pants, all its parts, or at least all those parts adapted to cover the buttocks and hips are made of the same knitted fabric, preferably a weft knitted fabric, double jersey, (alternatively the weft knitted fabric could also be of jersey, or ribbed knitting, or 1:1 ribbed, or interlock or plush).

The fabric preferably has a weight between 200 and 300 g/m$^2$ and more preferably between 230 and 270 g/m$^2$. Preferably the yarn of the knitted fabric comprises a natural fibre, for example cotton, and an elastomer, for example LYCRA, the elastomer percentage in the yarn being between 15% and 30% and is preferably about 20%. Although the entire pants or at least their part covering the buttocks and hips are made of the same knitted fabric, the presence of the inserts 150A and 150B means that those fabric portions to which these inserts are secured present a greater elastic modulus and greater tenacity than those parts of the pants surrounding said inserts.

Preferably, by virtue of the inserts the elastic modulus and tenacity increase by a value between about 5% and 30% more than the corresponding values of the fabric without these inserts. Because of these characteristics of those parts of the pants presenting the inserts and because of their shape and positioning, it has been found experimentally that the pants provide a retentive and shaping effect on the hips and a retentive and upward thrust effect on the lower portion of the buttocks.

The two parts 109A, 109B of the second element 109 are sewn together along their preferably rectilinear edge 109F (FIG. 11B), adapted to be positioned in the intergluteal cleft S4 and to overlie a central line of symmetry D1 of the rear part of the pants (this line D1 is represented only with reference to the embodiment shown in FIG. 1). Said rectilinear edge 109F having preferably the shape of a single rectilinear line.

According to one aspect of the invention, the two parts 109A, 109B must adhere to the buttocks as much as possible and their seam 116 (FIG. 10C) must enter the intergluteal cleft S4, so as to highlight and upgrade the appearance of the buttocks. To facilitate this insertion of the seam 116 of the two parts 109A and B of the element 109 into the intergluteal cleft, and hence enable the two parts to better bind the buttocks, the edges 109F of the two parts to be sewn together have the already described rectilinear shape. It should be noted that in known pants, the sewing edges provided at the rear central line of symmetry of the pants always have a curved shape (when the parts of the pants are seen in plan and have not yet been sewn together), i.e. a shape which aids buttock roundness in the finished pants; in contrast, according to the invention, this sewing line has a rectilinear shape, such that when the pants are worn, as there is a "lack of fabric" at the intergluteal cleft compared with the roundness of the buttocks, the fabric is pulled into the intergluteal cleft.

Advantageously those parts of the pants above and below the two parts 109A and B also have the same rectilinear edge shape. Hence the first part 107B presents a rectilinear edge 107I and the third part 110 also presents a rectilinear edge 110D, such that when these two parts and the parts 109A and B are sewn together they form two overlying rectilinear edges closed by the seam 116.

To improve insertion of the seam 116 (FIG. 10C) into the intergluteal cleft, advantageously a conventional elongated elastic element 117 (FIG. 10A) is also sewn to said seam, sewn preferably to the interior of the pants, and in a state of pretension, such that when the pants are worn, this elastic element pulls the seam and thrusts it into the intergluteal cleft. The same effect can also be obtained with a cord 18 (represented only with reference to the pants embodiment shown in FIG. 8), provided inside the pants and presenting a section sewn to the fork C of the pants, and for the rest slidable within a slot 19 (FIG. 8) provided in the seam 16 and with the free ends 18A emerging slightly below the waist 4 of the pants. By pulling the cord 18 and knotting its ends 18A the seam 16 can be pretensioned such that when the pants are worn, it enters the intergluteal cleft. It should be noted that the different solutions described to this point to facilitate insertion of the rear central pants seam 116 into the intergluteal cleft, or rather the rectilinear edge at the central rear seam 116, and/or insertion of the pretensioned elastic element 117 into the seam, and/or insertion of a cord 18 into the seam, are all solutions which can be used even in pants of conventional type to the expert of the art. These technical solutions are therefore not to be considered as limited to the pants according to the invention and could therefore form the subject of an independent patent. The third element 110 is adapted to cover an upper terminal band S5 of the buttocks and an upper front portion of the hips, to form the inner part of the front pockets 111. Advantageously, the major edge 110A is rounded to better adapt to the anatomy of the buttocks and to give the central part 109 of the pants a heart shape. It should be noted that a section of the lower major edge 110A is adapted to be secured to the arched upper edge 109E of each of the two parts of the element 109, and that between said two edges a fabric-free region of approximately triangular shape is present, by virtue of which an arched seam or dart 121 can be formed. It should be noted that the upper major edge 110B, which is substantially rectilinear and inclined, is adapted to be joined to the arched lower edge 123A of the waist element 123. The waist part 104 is produced as a single element 123 (FIG. 11A). The waist part 104 and the elements 110 must not move when the pants are worn and must cooperate with the upward traction action of the two parts 109A, 109B of the element 109 and finally with the lifting of the central part of the buttocks. To improve positioning of the waist part and further prevent its downward slippage, the inner face of the waist part 104 comprises an elastic tape 124 sewn thereto which remains in view (FIG. 10A), for example of silicone or with an outer silicone-coated surface, able to increase the adherence of the waist part 104 to the skin. Preferably according to the invention the height J2 (FIG. 10A) of the maximum point M8 of the rear portion of the waist 104 from the front fork C is significantly greater than the corresponding height J1 of the maximum point M9 of the front portion of the waist 104. Preferably the greater height J2 is greater than the lesser height J1 by a distance between 30% and 70% of J1, more preferably this distance being equal to about 50% of J1 (i.e. J2=J1+50% J1). For example, in a garment of size S, J1=18 cm and J2=27 cm.

Preferably, to better adapt to the more projecting and rounded central parts S3 of the buttocks, each of the two parts 109A and 109B can have a shape which can be two-dimensional for little pronounced buttocks, or a three-dimensional cup shape for more pronounced buttocks (see FIG. 7A in which the parts 109A and 109B are indicated by the number 9), i.e. a hollow convex shape with a perimetral edge of irregular shape. Consequently, according to the invention, pants having a determined size, for example size 40, are produced in a plurality, for example three, of different forms each having a particular buttock "size", i.e. with three different types of elements 109, preferably all the elements 109 having a substantially equal perimetral shape (the perimetral dimensions could possibly be different) and different convexities. Hence, for example, (with reference to FIG. 7A), the elements 9 (109) have a maximum point M5 at a first height H1, second elements 9 (109) have the maximum point at a second height H2 greater than the first, and third elements 9 (109) have the maximum point at a third height H3 greater than the second, for example between 2 and 3 cm.

Preferably the three-dimensional form of the two parts 109A, 109B is obtained by a conventional fabric preforming technique, of type similar to that used for some time in the brassiere cup production sector. This preforming technique enables cups to be obtained without internal seams (the cups comprise seams only along their perimeter) and can hence adhere better to the buttocks. As this production technique is conventional for the expert of the art, it will not be further described.

The front part 101 of the pants comprises, for each leg, an elongate element 105 which advantageously comprises the edge 105A (FIG. 11A) to be sewn to the corresponding element of the pants rear part 102, which in its upper part, above the knee, comprises a portion 105B which is curved such that at their top, at the hips and abdomen, the front part 101 of the pants has a width 100L1 (FIG. 10A) which is less than the overall width 100L of the pants when viewed frontally (FIG. 10A). Consequently when viewed frontally, the pants comprise, laterally at the hips, at least one portion 100A formed by at least one prolongation 100P1, 100P2 of the rear part 102 of the pants, and portions 103A of the lateral seams 103 which extend from the sides of the pants and above the knee, in the front part of the pants, with curved parts 103A. By virtue of this particular curvature of the elements 105 which form the pants front part 101, because of the curved front portions 103A of the seams 103, and by virtue of the prolongations 100P1-P2 of the rear part 102, when the garment is worn a visual slimming effect of the hips is achieved. Preferably the pants present two rear false pockets 130 (FIG. 11B) dimensioned and shaped such as to be sewn preferably along their entire perimeter, and each only onto one of the two parts 109A, 109B of the second element 109, to cover at least a central portion S3 of the buttocks. Advantageously, to favour the posture of the buttock, the pocket is dimensioned such as not to lie "flat" against the two parts 109A, 109B of the element 109 but such as to be secured with an excess of fabric. In other words, the false pockets are dimensioned and sewn such that they spread out and adhere to the underlying part of the pants only when the pants are worn. FIG. 10D shows the pants without the element 109 and without its two parts 109A and 109B.

FIGS. 12A, 12B, 12C show a second embodiment of pants according to the invention, representing a variant of the first embodiment of FIGS. 10A, 10B, 10C, 10D and 11A, 11B. Those parts of the pants in common with the previously described pants will not be further described in detail and will be indicated by the same number used with reference to FIGS. 10A, 10B, 10C, 10D and 11A, 11B plus 100.

The substantial differences compared with the previously illustrated pants are related to the fact that:

- the element 209 which covers the central part S3 has an even more accentuated form,
- the front seam 203A of the pants presents a first portion 203A' which extends from the sides of the pants into the front part of the pants, and a second portion 203A" which returns towards the sides of the pants and connects to the seam 221 of the rear elements 209, 210, 207B.

This second embodiment also presents inserts 250A and 250B (represented by a grey coloration in FIGS. 12A, 12B, 12C, 12D, even though in reality they are not visible when the pants are worn, being provided in the interior of the pants) in the first element 207B, adapted to cover at least a lower terminal portion S1 and a lateral portion S2 of the buttocks, to make two bands of said element 207B less elastic and more tenacious, and hence more retentive, these covering a hip portion, a lateral portion S2 and a lateral band S7 of the lower terminal portion S1 of the buttocks, preferably provided at the horizontal cleft S5 of the buttocks without however reaching the intergluteal cleft S4.

Preferably the pants produced in conformity with the previously described first embodiment (FIGS. 10A, 10B, 10C, 10D) are more suitable for small or medium buttocks, whereas those according to the second embodiment (FIGS. 12A, 12B, 12C, 12D) are more suitable for large or medium-large buttocks.

With reference to FIGS. 1, 1BIS, 2, 3, 4A, 4B, 5, these show pants according to a third embodiment of the invention.

Compared with the embodiments shown in FIGS. 12A, 12B, 12C, 12D and 13A, 13B, this third embodiment is more complex. Those parts of the pants in common with those previously described with reference to FIGS. 12A, 12B, 12C, 12D and 13A, 13B will not be further described in detail and will be indicated by the same number used with reference to FIGS. 12A, 12B, 12C, 12D and 13A, 13B less 100. The substantial differences between the pants of the first embodiment (FIGS. 12A, 12B, 12C, 12D) and third embodiment (FIG. 1) are related to the fact that to produce the different parts of the pants of the first embodiment a single knitted fabric is used, whereas in the third embodiment knitted fabrics are used having different characteristics, to perform a technical function substantially identical to that of the parts presenting the inserts 150A, 150B and of the parts without these inserts in the first embodiment. In the pants of the third embodiment, shown in FIGS. 1, 1BIS, 2, 3, 4A, 4B, at least the first 7B, the second 9 and the third element 4, 10 all comprise a knitted fabric but preferably presenting different modules of elasticity. Preferably, the fabric of the second element 9 presents an elastic modulus less (for example a modulus less by a percentage between 5% and 15%) than that of the first element 7B, and the fabric at least of the third element 10 presents an elastic modulus greater (for example a modulus greater by a percentage between 5% and 15%) than that of the first element 7B. the fabric of the second element 9 presents a weight less then those of the first element 7*b* and the third element 10, 4. The front part 1 of the pants also comprises elements of conventional type which will not be described in detail, these comprising (FIG. 4A) elements 6A, 6B for forming the front pockets, elements 6C for the zip, and usual elements 6D, 6E, 6F, 6G for forming the list, the zip cover and the loops.

Again in this embodiment the first element 7B, provided at the buttocks, presents two parts each comprising the two previously described regions Z1 and Z2 (and indicated by 100Z1 and 100Z2). The region Z2 (FIG. 5) of the first element 7B laterally comprises two prolongations P3 and P2 extending into the front part of the pants as previously described. Advantageously, the two prolongations P3 and P2 are separated from each other and comprise between one and the other a fabric-less region 15 by which a first seam or dart 13 can be formed, inclined (in lateral view FIG. 3) to a vertical axis by an angle Y1 between 110° and 165°, and preferably about 135°. As also explained hereinafter, by virtue of this dart 13 and of its accentuated inclination, an upward slandering effect is achieved for the figure, and furthermore at the rear that part of the first element 7B below the dart 13 is pulled upwards, cooperating in this manner to create an upward thrust effect on the buttocks. The first element 7B and the third element 10 are sewn together such as to also form a second seam or dart 14 inclined (in lateral view FIG. 3) to a vertical axis by an angle Y2 between 110° and 165°, and preferably about 150°, to ensure the same advantages as described with reference to the first dart 13. The first element 7B is advantageously made of a knitted fabric having a greater weight (for example a weight greater by 15-30%) and a higher elastic modulus (for example 5-15% higher) than those of the knitted fabric with which the two parts 9A, 9B of the second element 9 for the central part of the buttocks are made. Preferably the first element 7B is made of a weft knitted fabric, and more preferably of a double jersey weft knitted fabric (alternatively the weft knitted fabric could also be of jersey, or ribbed knitting, or 1:1 ribbed, or interlock or plush). The fabric preferably has a weight between 200 and 300 g/m$^2$ and more preferably between 230 and 270 g/m$^2$.

Preferably the yarn of the knitted fabric of the first element 7B comprises a natural fibre, for example cotton, and an elastomer, for example LYCRA, the elastomer percentage in the yarn being between 20% and 30% and is preferably about 25%, such that the fabric of the first element 7B is elastic but also highly retentive. The rear part 2 of the pants comprises two parts 9A, 9B of the second element 9, presenting substantially the same characteristics as the corresponding previously described parts 109A and 109B, and will therefore not be repeated. Preferably the two parts 9A, 9B of the second element are made of a weft knitted fabric, and more preferably of a single jersey weft knitted fabric (alternatively the weft knitted fabric could also be of jersey, or ribbed knitting, or 1:1 ribbed, or interlock or plush). The second element 9 is preferably made of a fabric having a weight between 150 and 250 g/m$^2$ and more preferably between 180 and 200 g/m$^2$.

Preferably the yarn of the knitted fabric of the two parts 9A, 9B of the second element 9 comprises a natural fibre, for example cotton, and an elastomer, for example LYCRA, the elastomer percentage in the yarn being between 15% and 25% and is preferably about 20%, such that the fabric of the elements 9 is not too retentive but neither too "limp" or too little retentive. The third element 10 is made of a weft knitted fabric, and more preferably of a double jersey weft knitted fabric, (alternatively the weft knitted fabric could also be of jersey, or ribbed knitting, or 1:1 ribbed, or interlock or plush). Preferably the fabric of the third element 10 is the same as that used for the first element 7B. Advantageously however, to increase the rigidity of this third element 10, in the fabric a more rigid fabric is inserted, i.e. of high tenacity, for example a light shuttle woven fabric or a mesh made of a non-deformable substantially anelastic material (i.e. of high elastic modulus). The third element 10 or even just a part thereof is preferably made by superposing three fabric layers: an inner layer of knitted fabric, an inner layer of a non-deformable anelastic fabric, and an outer layer of knitted fabric. By virtue of this insertion of a fabric of greater tenacity, the third element 10 and also, as explained hereinafter, the waist part 4, form elements of the pants which when worn are able to remain in a fixed position such as not to undergo significant modification, consequently the second element 9 made of a light elastic fabric and connected to the third element 10 via the dart 21 creates a sort of "pretensioning" region such that when the pants are worn, they are subjected to an upward traction force W (FIG. 3) which results in an effect of at least partial lifting of the buttock part covered and retained by the second element 9, while at the same time thrusting the seam 16 into the intergluteal cleft.

A similar upward traction effect, even though less accentuated, is also induced on the upper portion of the first element 7B, secured to the third element 10 by the dart 14 (FIG. 1).

The waist part 4 is formed by sewing together front waist elements 22 (FIG. 4A) and rear waist elements 23 (FIG. 4B) made of a fabric having the same characteristics as that with which the third element 10 is made. These waist elements must also not shift while the pants are worn and must cooperate with the upward traction action of the two parts 9A, 9B of the second element 9 and finally with the lifting of the central part of the buttocks.

To improve the positioning of the waist part and further prevent its downward slippage, the inner face of the waist elements 22, 23 comprise an elastic tape 24 sewn thereto which remains in view (FIG. 9), for example of silicone or with an outer silicone-coated surface, able to increase the adherence of the waist part 4 to the skin.

In the three embodiments of the pants the fact that they present a very high waist, and a low front waist, as already described, on the one hand accentuates the slendering effect of the hips, and on the other hand enables the waist part 4, 104, 204 to position itself in a position substantially above or approximately at the upper edge of the buttocks, or rather approximately at the hip joint when the pants are worn. From this position, by virtue of the particular shape of the previously described components of the rear part of the pants, the waste part 4, 104, 204 and the third elements 10, 110, 210 are able to exert an upward traction force on the underlying pants components (the two parts 9A, 9B, 109A, 109B, 209A, 209B of the element 9, 109, 209 and the first elements 7B, 107B, 207B of the legs 7, 107, 207) which results:

- in an upward at least partial thrust at least on the central parts of the buttocks,
- in the thrusting of the central rear seam 16, 116, 216 of the pants into the intergluteal cleft,
- in a significant adherence of the rear fabric of the pants to the buttocks.

This combination of effects results overall in a reshaping of the forms of the buttocks of the wearer of the pants.

Finally it should be noted that the aforedescribed embodiments have been provided by way of example and that numerous variants are possible, all falling within the same inventive concept, and that, in particular, the shape and/or dimensions, and/or the materials of the different parts of pants according to one of the embodiments could also be used in another of the embodiments. Thus for example in the pants of the first or second embodiment, instead of the plastic inserts the inserts could be made of the three different types of fabric described with reference to the third embodiment, or vice versa the pants of the third embodiment could comprise inserts similar to those of the first or second embodiment and be made of a single fabric with inserts. The same also applies with reference to the shape and dimensions, in particular of the parts 9A, 9B, and 109A, 109B, and 209A, 209B, of the seams 3A, 103A, 203A, of the third elements 10, 110, 210, of the first elements 7B, 107B, 207B, which could be transferred to first, second or third pants and vice versa.

It should be noted that the invention also relates to a set of pants, for example pants all having the same size in which all pants of said set comprise: a first rear part 2. 102, 202 adapted to at least partially cover the buttocks, a second front part 1, 101, 201 adapted to at least partially cover the abdomen, and in which in all the pants of said set, said first and said second part have substantially the same shapes and dimensions with the exception of a central portion 9, 109, 209 of said first part 2, 102, 202 adapted to cover at least a central portion S3 of the buttocks, and presenting a shape and/or dimensions which are different for all pants of said set, to hence produce pants which all have the same size but are able to adapt to different dimensions of the central portions S3 of the buttocks of the pants wearer. According to the invention, pants can therefore be produced all having the same size but with rear central portions provided at the central portions S3 of the two buttocks which are of different form such as to be able to adapt to the different buttock shapes of the pants wearer. According to the invention, pants can for example be produced which at the two central portions S3 of the buttocks present flat or substantially flat portions (for slightly projecting and slightly rounded buttocks) or cup-shaped portions with cups having different depths (for example cups for very projecting and rounded buttocks and cups for medium projecting and rounded buttocks).

It should also be noted that advantageously the pants of the invention comprise an extremely limited number of components in that their rear part adapted to cover the buttocks is essentially formed by sewing together only a limited number of parts. The pants can therefore be produced easily and quickly using techniques and machines of usual type.

The invention claimed is:

1. Pants for shaping the female buttocks and hips, comprising:

a first rear part adapted to at least partially cover the buttocks, a second front part adapted to at least partially cover the abdomen, the first part comprising:

a first element adapted to cover a lower terminal portion and lateral portion of the buttocks, a second element adapted to cover a central portion of the buttocks, and a third element adapted to cover at least an upper terminal portion of the buttocks, wherein:

the first rear part and the second front part are outer parts visible when the pants are worn, each of the first element, second element and third element of the first part comprises a knitted fabric and each of the first element, second element, and third element is an outer element, edges of the first element and third element entirely define a central aperture, outer edges of said second element secured to the edges of the first element and third element defining the central aperture by an annular seam to close the central aperture, the annular seam is an outer seam, and the second element comprises two second element parts, each adapted to cover only one of the two central parts of the buttocks, the two second element parts secured together along respective lateral edges for being provided at an intergluteal cleft of the buttocks by a second element central outer seam adapted to be positioned at the intergluteal cleft;

the first element comprises only two first element parts, each said first element part comprising a region adapted to cover the lower part and lateral portion of only one of the buttocks, the two first element parts regions secured together along respective lateral edges for being provided at the intergluteal cleft of the buttocks by a first element central outer seam adapted to be positioned at the intergluteal cleft, the first element outer central seam extending continuously from a crotch of the pants to the second element outer central seam, opposed edges of the first element are attached to the second front part, wherein an edge of each first element part is attached to the second front part by first element lateral seams, said first element lateral seams being outer seams;

wherein the third element comprises an upper element adapted to cover an upper terminal band of the buttocks and joined to a waist element by an outer seam;

wherein the third element upper element comprises two third element parts, each of said third element parts comprising a region adapted to cover the upper terminal portion and an upper lateral portion of only one respective said buttock, the two third element parts regions each having a first lateral edge and an opposed second lateral edge;

the two third element parts regions secured together along respective first lateral edges for being provided at the intergluteal cleft of the buttocks by a third element central seam adapted to be positioned at the intergluteal cleft, the third element central seam extending continuously from the second element central seam, wherein the first, second and third elements are attached to provide a continuous intergluteal cleft seam from the crotch to the upper end of the buttocks;

wherein the second lateral edge of each third element part is attached to the second front part;

wherein the third element comprises a lower edge; the lower edge being rounded to better adapt to the anatomy of the buttocks and to give the central part of the pants a heart shape, the lower edge being adapted to be sewn by an outer seam to a corresponding arched edge of the second element adapted to cover at least a central portion of the buttock, wherein the upper seam portions connecting the third elements and the second element are arched shaped and join in a central V-shaped part, symmetrically divided by the intergluteal seam, and the lower and lateral seam portions connecting the first element and the second element are arched shaped and have an opposed concavity with respect to the concavity of the opposed upper seam portions.

2. The pants as claimed in claim 1, wherein at least the joined-together edges of the two parts which form the second element have, before being sewn together, a rectilinear shape in plan view, to facilitate insertion of the seam of the edges into the intergluteal cleft of the buttocks and the adherence of the two parts which form the second element to the buttocks when the pants are worn.

3. The pants as claimed in claim 1, wherein at least one parameter selected from the group consisting of the modulus of elasticity and the tenacity of at least two portions of the first element is greater than the respective at least one parameter selected from the group consisting of the modulus of elasticity and the tenacity of the second element adapted to cover at least a central portion of the buttocks, by a value between 5% and 30% of the corresponding value of the respective at least one parameter selected from the group consisting of the modulus of elasticity and the tenacity of the second element, wherein each of the at least two portions of the first element are each adapted to cover at least a lower terminal portion of the buttocks, a lateral portion of the buttocks, and a portion of the hips but not also the lower central portion of the buttocks and the crotch.

4. The pants as claimed in claim 1, wherein in the first rear part an entire central seam comprising the first element central seam, the second element central seam, and the third element central seam is provided adapted to be positioned to correspond with the intergluteal cleft, the central seam presenting an insertion member to facilitate the insertion of the seam into the cleft, the insertion member comprising a member selected from the group consisting of:

an elongated elastic element sewn to the interior of the pants onto said seam in a state of pretension, such that when the pants are worn, the elastic element pulls the seam and urges the seam into the intergluteal cleft, or, as an alternative to the elastic element, a cord provided inside the pants and presenting a sewn section and a fork and for the rest slidable within a slot provided at the seam and with free ends which emerge from the slot at a waist part such that on pulling the cord and knotting its ends, the seam can be pretensioned to facilitate insertion into the cleft.

5. The pants as claimed in claim 1, wherein the first element presents at least two inserts rigidly secured to an inner face of only the first element at two different portions of the first element, each of the inserts being provided at that part of the pants adapted to cover a portion of the hips, a lateral portion of the buttocks, and a lower lateral portion of the buttocks but not also the lower central portion of the buttocks and the crotch and not a front upper terminal portion of the hips and not the waist portion.

6. The pants as claimed in claim 5, wherein the inserts are made of a plastic material, the inserts being made to adhere to and being secured to the inner face of the first element.

7. The pants as claimed in claim 5, wherein the inserts are made of a material having a thickness between 0.02 and 0.5 mm, and at least one of the following characteristics: weight between 30 and 130 g/m2, surface continuous, and presenting a plurality of holes to facilitate breathability.

8. The pants as claimed in claim 1, wherein at least the first rear part adapted to at least partially cover the buttocks, and the second front part adapted to at least partially cover the abdomen, and the first element adapted to cover at least a lower terminal portion and lateral portion of the buttocks, and the second element adapted to at least partially cover a central portion of the buttocks, are all made of the same knitted fabric having identical technical characteristics for all the parts and elements.

9. The pants as claimed in claim 1, wherein each of the two parts of the second element presents a cup shape.

10. The pants as claimed in claim 1, wherein a first distance measured between a highest point of a waist part of the first rear part and a fork of the pants is greater than a second distance measured between a highest point of the waist part of the second front part and said fork, the difference between the first distance and the second distance being at least equal to 30% of the second distance.

11. The pants as claimed in claim 1, wherein:

the first element and the third element extend to lateral parts of the buttocks and are prolonged from the first rear part of the pants into the second front part, and the first rear part and second front part are joined together by lateral seams which extend into the second part at least to positions corresponding with the part of the pants adapted to cover the abdomen.

12. The pants as claimed in claim 1, wherein each of the two parts of the second element presents an upper edge to be connected to a corresponding lower edge of a portion of the third element, the upper edge presenting an arched shape facing a fork of the pants, and said lower edge presenting a rectilinear or arched shape different from that of the upper edge, such that when the two elements are brought together before being connected together, they determine a fabric-less region to be closed by a seam which joins the edges together.

13. The pants as claimed in claim 1, wherein the first element adapted to cover at least a lower terminal portion and lateral portion of the buttocks, comprises an inner arched edge, adapted to be sewn to a corresponding arched edge of the second element adapted to cover at least a central portion of the buttocks.

14. The pants as claimed in claim 5, wherein the inserts are made of a polyurethane, said inserts being made to adhere to and being secured to the inner face of the first element.

15. The pants as claimed in claim 1, wherein in the first rear part an entire central outer seam comprising the first element central outer seam the second element and the third element central seam is provided adapted to be positioned to correspond with the intergluteal cleft, the central outer seam presenting an insertion member to facilitate the insertion of the seam into the cleft, the insertion member comprising an elongated elastic element sewn to the interior of the pants onto the seam in a state of pretension, such that when the pants are worn, the elastic element pulls the seam and urges the seam into the intergluteal cleft.

16. The pants as claimed in claim 1, wherein in the first rear part a central seam is provided adapted to be positioned to correspond with the intergluteal cleft, the central seam presenting members to facilitate the insertion of the seam into the cleft, said members comprising a cord provided inside the pants and presenting a sewn section and a fork and for the rest slidable within a slot provided at the seam and with free ends which emerge from the slot at a waist part such that on pulling the cord and knotting its ends, the seam can be pretensioned to facilitate insertion into the cleft.

17. The pants as claimed in claim 1, the third element comprises two third element parts, each of said third element parts comprising a region adapted to cover only one of the two upper terminal portion of the buttocks, the two third element parts regions secured together along respective lateral edges for being provided at the intergluteal cleft of the buttocks by a third element central seam adapted to be positioned at the intergluteal cleft, the third element central seam extending continuously from the second element central seam, wherein the first, second and third elements are attached to provide a continuous intergluteal cleft seam from the crotch to the upper end of the buttocks.

18. The pants as claimed in claim 17, wherein in the first rear part an entire central seam comprising the first element central seam, the second element central seam, and the third element central seam central seam is provided adapted to be positioned to correspond with the intergluteal cleft, the outer central seam presenting an insertion member to facilitate the insertion of the central seam into the cleft, the insertion member comprising an elongated elastic element sewn to the interior of the pants onto said seam in a state of pretension, such that when the pants are worn, the elastic element pulls the seam and urges the seam into the intergluteal cleft, wherein the elastic elements extend through the entire intergluteal cleft seam of the three elements.

19. The pants as claimed in claim 1, wherein the first and second part are joined together by lateral seams which extend into the second part at least to positions corresponding with the part of the pants adapted to cover the abdomen.

* * * * *